United States Patent [19]

Brunner

[11] 4,406,305

[45] Sep. 27, 1983

[54] CONTROL VALVE

[75] Inventor: Rudolf Brunner, Baldham, Fed. Rep. of Germany

[73] Assignee: Heilmeier & Weinlein, Munich, Fed. Rep. of Germany

[21] Appl. No.: 222,701

[22] Filed: Jan. 5, 1981

[30] Foreign Application Priority Data

Jan. 9, 1980 [DE] Fed. Rep. of Germany ..... 3000592

[51] Int. Cl.[3] ..... F15B 13/08

[52] U.S. Cl. ..... 137/596; 137/596.13; 137/625.68

[58] Field of Search ..... 137/596, 596.13, 625.68

[56] References Cited

U.S. PATENT DOCUMENTS 3,820,568 6/1974 Brunner et al. ..... 137/625.68

*Primary Examiner*—Gerald A. Michalsky

*Attorney, Agent, or Firm*—Kinzer, Plyer, Dorn & McEachran

[57] ABSTRACT

An assembly of control valves in which each valve has a piston sliding in the bore of a housing to traverse a neutral position and two control positions; the piston has a flow path therethrough and this flow path is combined with additional ducts or recesses in the piston so that in the neutral position as well as in both control positions the piston provides a through-flow between fluid return connections communicating with the bore.

6 Claims, 9 Drawing Figures

CONTROL VALVE

DESCRIPTION

Figure 1:
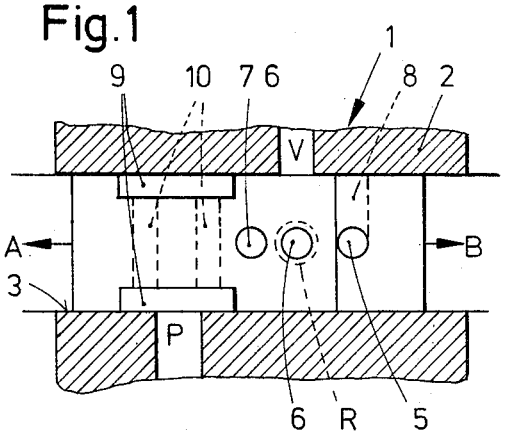

The invention relates to a control valve of the kind set forth in a preamble of the main claim.

In such control valves both sections of the return flow duct interrupted by the slide bore are interconnected by a circumferential duct in the housing, which then permits a free passage of the exhaust pressure medium, when the piston slide is in a position in which it blocks off the return flow duct connections in the slide bore. With control valves, which can supply alternatively two consumers and each has a return flow duct for each consumer connection, a transverse duct is provided between the two return flow ducts in the housing, so that a pressure medium flowing in one return flow duct can then be transferred to the other return flow duct, if the one return flow duct is blocked off by the location of the piston slide. Transverse ducts or circumferential ducts necessitate, however, a large manufacturing expenditure, since control valve housings of small size are made in accordance with modern specification conceptions so that they do not include a large number of ducts, valves, filters or the like which necessitate appropriate space provision, and since in particular in mass production of valve housings the transverse bores or circumferential ducts necessitate a comparatively high cost and high manufacturing effort.

The invention is based on the problem of providing a control valve of the hereinbefore defined kind, the housing of which is characterised by a compact construction and by simple manufacturing capability, and in which in all positions of the piston slide any return flow duct remains capable of receiving flow. The indicated problem is solved in accordance with the invention by the features set out in the characterising clause of the main claim.

According to this conception the piston slide alone is responsible for the fact that in any of its control positions the free passage of the return flow duct remains open. In particular in a control valve assembly there is thereby avoided a configuration in which a valve downstream in the flow direction of the return flow system interrupts the return flow of the upstream valve. Transverse bores between the return flow ducts or circumferential ducts or the return flow system becomes superfluous. The corresponding construction of the piston slide calls for no substantial additional expenditure, since machining must be undertaken in any event by which it receives the flow ducts for the pressure medium supply for the consumer connections and the like.

A preferred embodiment of a control valve in accordance with the invention, in which the return flow duct extends in relation to the slide bore in a radially offset plane to the consumer and pump connection and the return flow connections lie in a longitudinal section of the housing bore, which by the position of the consumer connection on the one hand and the position of the return flow connection on the other hand is limited to at the most about one half of the sum of the clear width of the user connection, and of a return flow connection in relation to the user connection. As a result of this offsetting of the ducts from the plane of the consumer supply from the pump inlet opening the features relating to the piston slide can overlap one another in the piston slide longitudinal direction, without the danger of the pressure medium overflow from one zone into another.

There results from this a favourable optimum short piston slide length.

A further, preferred embodiment of the invention is particularly simple from a manufacturing technique standpoint. The pressure medium in the return flow system is subject to only very small changes in direction. The flow resistances are small even at high working pressures.

A further, preferred embodiment of the invention enables a simple manufacturing technique to be applied. They can in other respects be made similarly to the flow pockets which are provided for the supply of the user connections from the pump supply opening. Even if the flow pockets overlap the supply and the flow pockets for the return flow system in the piston slide longitudinal direction, there is no non-permissible sealing action between these zones, since the flow pockets lie angularly offset in the peripheral direction of the piston slide in relation to one another. The recess then makes preferred provision for the flow connection between the user connection, and the return flow duct, while the two through flow bores in the further piston slide positions provide for a non-throttled passage of the return flow duct.

A still further preferred construction of the invention is one wherein the recess is so dimensioned, that it provides already in two control positions of the piston slide for the through flow of the return flow duct. The additional through flow bore or pockets open to the recess can be carried out by a manufacturing technique which is simple. In the latter case then the recess is responsible for the pressure medium flow control in all three positions of the piston slide.

Figure 2:
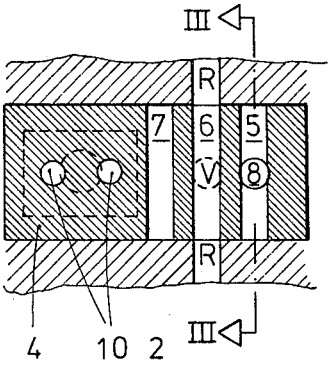
Figure 4:
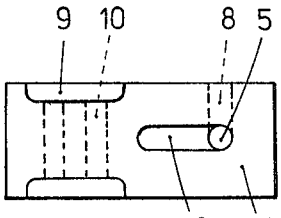
Figure 5:
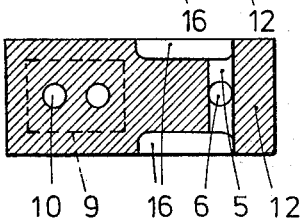
Figure 3:
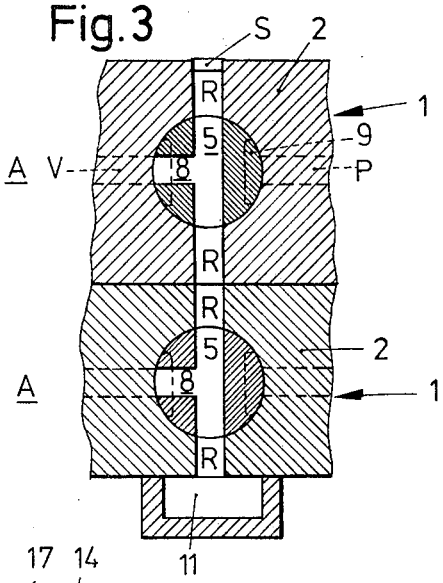
Figure 6:
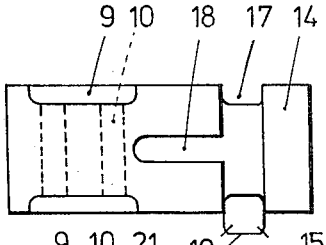
Figure 7:
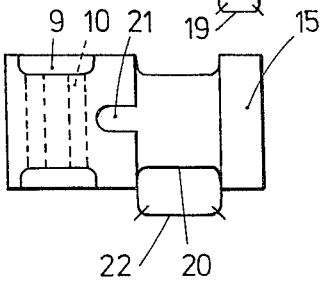
Figure 8:
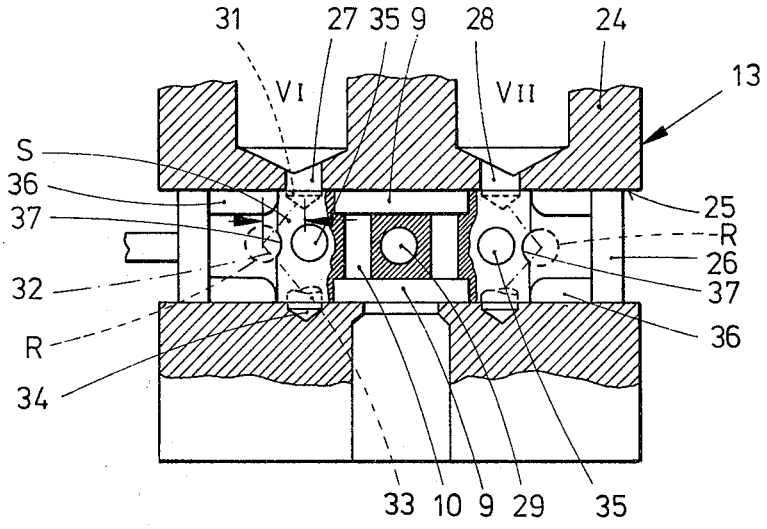
Figure 9:
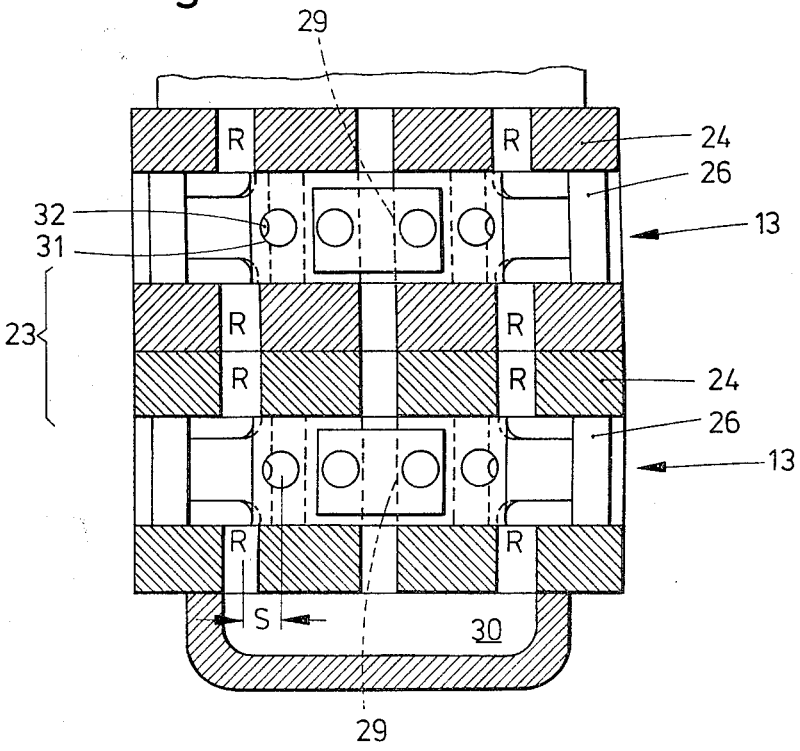

Embodiments of the invention are explained hereinafter with reference to the drawing. There is shown in:

FIG. 1 an axial section through a control valve for a consumer,

FIG. 2 a sectional view of the control valve of FIG. 1 turned through 90°, FIG. 3 a cross-section through a control valve assembly with control valves according to FIGS. 1 and 2, in the plane III—III of FIG. 2, FIG. 4 is a side view of a further embodiment of a piston slide, FIG. 5 the piston slide of FIG. 4 in a sectional view turned through 90° in relation to FIG. 4, FIG. 6 a further embodiment of a piston slide, FIG. 7 a further embodiment of a piston slide, FIG. 8 a longitudinal section through a further embodiment of a control valve, FIG. 9 a sectional view turned through 90° of the control valve of FIG. 8 in a control valve assembly with two control valves.

In FIGS. 1 and 2 two longitudinal sections are illustrated through a control valve 1 with a housing 2, which is combined in FIG. 3, with a control valve 1 of the same kind as a control valve assembly. A piston slide 4 of generally cylindrical form is displaceable within a slide bore 3 from the illustrated neutral position into two control positions A and B. A pump connection P is supplied with pressure medium which is suitable for a consumer connected to a consumer connection V. The pump connection lies diametrically opposite to the user connection V so that these are offset in relation to one another in length direction of the slide bore. In the neutral position of the piston slide 4 there is provided in the longitudinal direction of the piston slide stroke in one of the control positions a flow path in the form of a T-shaped bore provided through the piston slide 4. The bore section 5 extends angularly off-set by 90° in relation to the plane of the pump connection, and of the consumer connection V and leads from the upper side of the piston slide 4 to its under side. A connection bore 8 is provided for the through flow bore 5 at the level of the user connection V. The housing is similarly traversed at right angles to the plane of the user connection V and of the pump connection P by a return flow passage R which is divided by the slide bore into two sections. Thereby there are formed in the slide bore 3 two diametrically opposite return flow connections. In the illustrated neutral position the return passage R is completed within the piston slide 4 by a passage bore 6. In order to offset the piston slide stroke in relation to the flow bore 6 the piston slide has therethrough a further bore 7, which completes, in the control position B of the piston slide, the through path of the return passage. Opposite the pump connection P there is provided in the piston slide 4 a longitudinally-extending flow pocket 9, which lies diametrically opposite a further flow pocket 9. The flow pockets 9 are connected for the passage of pressure medium by connection passages 10. In FIG. 3 two control valves 1 are so mounted together that their return flow ducts coincide and lead to a return collection space 11, which lies outside the second control valve 1.

In each control position of the piston slide one of the three through flow bores 5, 6 and 7 is in communication with both of the return flow connections R. The end of the return flow duct R in the upper control valve 1 is preferably closed off by a plug S. In this way it is ensured that the pressure medium from the user connection V of the upper control valve in FIG. 3 will then flow out into the return flow collector space 11, when the piston slide 4 of the upper control valve 1 lies in its control position, and indeed independently the position of the piston slide 4 of the lower control valve of FIG. 3. Additional by-pass passages around the slide bores are not necessary for the return flow system.

A further embodiment of a piston slide 12 is illustrated in FIGS. 4 and 5 which can be incorporated in place of the piston slide 4 of FIGS. 1 to 3. This consists again of through-flow bores 10 connecting flow pockets 9 as well as a T-shaped flow path 5, 8 which can be connected in the flow position A of the piston slide 12 between the user connection V and the return flow connections R. For providing for the return flow in both of the other positions of the piston slide there are provided flow pockets 16 off-set by 90° in relation to the flow pockets 9, which likewise extend in the longitudinal direction of the piston slide 12. The flow paths 5, 8 lie within the longitudinal extent of the flow pockets 16.

In a further embodiment of a piston slide 14 according to FIG. 6 the flow path which is responsible for the connection of the user connection V with the return flow duct R in the control position A of the piston slide 14, is formed by a circumferential recess 17, which has a width 19, which corresponds substantially to the open width of the user connection V or of the return flow connection R. Flow pockets 18 extending in the longitudinal direction of the piston slide 14 and opening into this recess provide for the passage of return flow in both the further positions of the piston slide 14.

A piston slide 15 according to FIG. 7 has a connection recess 20 acting as a flow path for the connection of the user connection with the return flow, the width 22 of which is approximately double the open width of the user connection V or of the return flow connection R. The recess 20 forms the through flow passage in reverse circulation both in the neutral position of the piston slide 40 and in the central position A. For the control position B there are provided short, longitudinal-extending, flow pockets 21 for an unhindered passage of the return flow.

In FIGS. 8 and 9 a control valve 13 is illustrated in longitudinal section, which according to FIG. 9 is combined with a flow valve of the same kind to form a control valve assembly 23. In the housing 24 of the control valve 13 a slide bore 25 is provided for a piston slide 26 prevented from rotation in a manner not explained in detail. A pump connection serves for the supply of the consumer connections 27 and 28 for two alternately operated consumers VI and VII. For this purpose there are formed in the piston slide 26 the above-mentioned flow pockets 9 through-flow bores 10 in the piston slide 26. A bore 29 extends between the through flow bores 10 perpendicularly thereto and serving for the so-called pressureless circulation not further explained in detail. From FIG. 9 it is apparent that the housing 24 of the two control valves is formed with through-flow bores which lead in the illustrated neutral position of the piston slide 26 for the pressureless through flow into a collection chamber 30 on the underside of the control valve system 23 of the latter control valve.

The user connections 27 and 28 lie diametrically opposite the pump connection and are offset in the longitudinal direction of the slide bore 25 in relation thereto. In the outer periphery of the piston slide 26 a recess 31 is associated with each user connection 27 and 28, which is connected by a pressure-balancing duct 32 with a corresponding recess 33, which corresponds to a recess 34 in the slide bore 25 of the housing. In the illustrated neutral position of the piston slide 26 there is effected in this way a pressure balance of the pressure medium lying in the consumer connection 27 or 28, which relieves the piston slide of clamping forces. Perpendicular to the plane, in which the pumping connection and the user connections 27 and 28 lie, the piston slide 26 is traversed for each user connection 27 with a through flow bore 35.

As a flow path for the connection of each user connection 27 with a return flow duct R, of which the return flow connections lie diametrically opposite within the slide bore 25, a peripheral recess 36 is provided within the piston slide. Since the return flow connections R are offset in relation to the user connections 27 or 28 by a distance S, which corresponds to more than half of the sum of the open widths of the two connections, the recess is slightly extended by rounded bulges 37, which in the illustrated neutral position serve the purpose that in each housing the return flow duct sections, which are separated from one another by the slide bore 25, are connected uninterruptedly with one another by the recess 36. The through-flow bore 35 is offset by about the length of the piston slide stroke between the neutral position and an open position in relation to the bulge 37, so that once again the return connections R are interconnected, when the piston slide 26 is moved into a control position, in which one consumer connection 27 or 28 is connected with the return flow. As a result of the angular displacement between the planes, in which the pump connection P and the consumer connections 28 and 27 lie, and the plane of the pressure-free through flow and of the return flow systems there can be achieved an optimum short constructional length of the piston slide 26 and naturally also the housing 24 of the control valve 13. The housing can be made compact and space saving, since neither by pass ducts nor transverse connecting ducts are necessary between the return flow ducts, but the piston slide 26 provides at any given time automatically an unhindered through path for the return flow. The return flow ducts discharge from the lower control valve 13 shown in FIG. 9 into a common collecting chamber 30. In place of the through flow bores 35 flow pockets which extend longitudinally can be employed, which extend up to the recess 36 and the through flow between the return flow ducts R are maintained, when the piston slide is moved into its control positions. Such an embodiment would correspond substantially to that shown in FIG. 7 for the supply of only one user connection.

I claim:

1. Control valve of a control valve assembly having a neutral position and two control positions and consisting of at least two interconnected substantially identical control valves, each valve with a housing traversed by a slide bore and a piston slide moveable in the bore from a neutral position longitudinally into two opposed control positions, and restrained from rotation, each housing with a pump connection (P) and at least one consumer connection (V) off-set thereto in the longitudinal direction of the bore, and with two return flow connections (R) opening into the slide bore to cooperate with the consumer connection and off-set from one another in the circumferential direction, the return flow connections belonging to a return flow duct traversing the housing, and with a flow path in the piston slide with which in one control position the consumer connection is connected to the return flow duct, characterized in that the piston slide (4, 12, 14, 15, 26) the flow path in the piston (5, 8; 17; 20; 36) is combined with additional piston slide passages (6, 7; 16; 18; 21; 37, 35) arranged so that both in the neutral position and also in each control position (A, B) the piston slide provides a through-flow connection between the return flow connections (R) within the slide bore (3; 25).

2. Control valve according to claim 1, in which each return flow connection extends in a radially offset plane to the consumer and pump connections and the return flow parallels a longitudinal section of the bore housing, which is limited by the position of the consumer connection on the one hand and the position of the nearest return flow connection on the other hand, which plane is offset at the most by one half of the sum of the open widths of the consumer connection and of the return flow connection nearest thereto in relation to the consumer connection, characterized in that passages (6, 7; 16; 18; 27; 37, 38) are arranged in the peripheral regions of the piston slide (4, 12, 14, 15, 26).

3. Control valve according to one of claims 1 or 2, characterised in this that the flow path (5, 8) is a spanning T-shaped duct passing through the piston slide and angularly displaced in relation to the consumer connection (V), to which extend within the piston slide in the longitudinal direction to off-set the piston slide stroke two flow connections as traversing bores (6, 7) in each of the piston slide positions.

4. Control valve according to one of claims 1 or 2, characterised in this that in the peripheral regions of the piston slide (12, 14, 15) lie diametrically opposite longitudinally-extending flow pockets (16, 18) in the longitudinal extent of which the flow path (5, 8; 17, 20) lies.

5. Control valve according to claim 1 characterised in that the flow path is a circumferential recess in the piston slide combined with at least one passage (6, 7, 35) penetrating the piston slide in the plane of the return flow.

6. Control valve according to claim 5 characterised in that the recess (20; 36) has such a width that it maintains a connection in the neutral position and in the first control position with the return flow connections (R), and that the circumferentially extending recess (17, 20) is combined with longitudinally extending recesses (18, 21).

* * * * *